US008586278B2

(12) United States Patent
Sukeno et al.

(10) Patent No.: US 8,586,278 B2
(45) Date of Patent: Nov. 19, 2013

(54) ELECTROSTATIC IMAGE DEVELOPING TONER AND PRODUCING METHOD OF THE SAME

(75) Inventors: Mikihiko Sukeno, Hyogo (JP); Hajime Tadokoro, Kanagawa (JP); Ken Ohmura, Tokyo (JP); Tatsuya Nagase, Tokyo (JP); Tomomi Oshiba, Tokyo (JP); Kenji Hayashi, Tokyo (JP); Saburou Hiraoka, Tokyo (JP); Tomoko Mine, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 98 days.

(21) Appl. No.: 13/272,558

(22) Filed: Oct. 13, 2011

(65) Prior Publication Data

US 2012/0100478 A1 Apr. 26, 2012

(30) Foreign Application Priority Data

Oct. 21, 2010 (JP) ..... 2010-236064

(51) Int. Cl.
*G03G 9/093* (2006.01)

(52) U.S. Cl.
USPC ..... 430/137.12; 430/137.14

(58) Field of Classification Search
USPC ..... 430/137.12, 137.14
See application file for complete search history.

(56) References Cited

U.S. PATENT DOCUMENTS

| | | | | |
|---|---|---|---|---|
| 3,998,747 | A * | 12/1976 | Yamakami et al. | 430/108.23 |
| 2008/0199797 | A1 * | 8/2008 | Sacripante et al. | 430/104 |
| 2010/0055592 | A1 * | 3/2010 | Zhou et al. | 430/108.4 |
| 2010/0330486 | A1 * | 12/2010 | Zhou et al. | 430/108.4 |

FOREIGN PATENT DOCUMENTS

| | | |
|---|---|---|
| JP | 2008-256913 | 10/2008 |
| JP | 2008-262166 | 10/2008 |
| JP | 2009-223281 | 10/2009 |
| JP | 2010-055094 | 3/2010 |

* cited by examiner

*Primary Examiner* — Peter Vajda
(74) *Attorney, Agent, or Firm* — Lucas & Mercanti, LLP

(57) ABSTRACT

A method of producing an electrostatic image developing toner comprising toner particles comprising a binder resin containing at least a non-crystalline polyester resin having a crosslinking structure and a crystalline polyester resin, the method comprising the steps of (a-1) preparing a crystalline polyester resin particle aqueous dispersion liquid; (a-2) preparing a polymerizable unsaturated non-crystalline polyester resin aqueous dispersion liquid; (b) preparing crosslinking non-crystalline polyester resin particles by adding a radical polymerization initiator to the aqueous dispersion liquid of particles containing the non-crystalline polyester resin having a polymerizable unsaturated bond; (c) preparing core particles by aggregating at least the particles containing the crystalline polyester resin in an aqueous medium; and (d) preparing a shell layer containing the non-crystalline polyester resin having a crosslinking structure by fusing the particles containing the non-crystalline polyester resin having a crosslinking structure on surfaces of the core particles in an aqueous medium.

12 Claims, No Drawings

ELECTROSTATIC IMAGE DEVELOPING TONER AND PRODUCING METHOD OF THE SAME

This application is based on Japanese Patent Application No. 2010-236064 filed on Oct. 21, 2010 in Japanese Patent Office, the entire content of which is hereby incorporated by reference.

TECHNICAL FIELD

The present invention relates to an electrostatic image developing toner (hereafter, simply referred to as a toner) and a method of producing the same.

BACKGROUND OF THE INVENTION

Recently, energy saving for an electrophotographic image forming apparatus has been desired in view of countermeasure of global environment contamination, and, specifically, energy saving for a fixing system which consumes a big amount of energy among an electrophotographic image forming apparatus has been desired.

So far, a resin having sharp melt property, specifically, a crystalline polyester resin, has been known to be used in a toner as a binder resin for one of effective methods for low temperature fixing. Further, a method to use a polyester resin having a crosslinking structure having excellent high temperature elasticity has been known to dissolve problems such as poor anti-high temperature offset property, poor high temperature storage property or too much gloss caused by using a crystalline polyester resin (see, for example, patent document 1).

However, it is difficult to produce a toner containing a polyester resin having a crosslinking structure and having a small particle diameter by the above described toner producing method, according to the following reason, and, therefore, an image having high quality is difficult to be formed by using such a toner.

Namely, it has been known that a toner having a small particle diameter can be produced by employing a polymerization method. However, it is difficult to produce a toner containing a polyester resin since it is difficult to fully conduct the reaction in an aqueous medium because polyester is obtained by a dehydration condensation reaction. As a countermeasure, there has been proposed a method in which a polyester resin preliminarily formed by a dehydration condensation reaction is dissolved in an organic solvent, and dispersed in an aqueous medium, for example, by a phase-transfer emulsification method, to obtain an emulsion liquid, whereby toner particles are formed using the emulsion liquid. However, even when such a method is used, there is a problem because the polyester resin having a crosslinking structure is difficult to be dissolved or dispersed in an organic solvent and needs plenty of energy to dissolve or disperse the polyester resin.

In order to solve the above mentioned problem, employed is a method to use a polyester in which an isocyanate group is introduced to form a crosslinking structure simultaneously when the particles are formed (see, for example, patent documents 2 and 3).

However, the problem is that it is difficult to control the reaction and impossible to stably produce a toner because of the extremely high reactivity of the isocyanate group.

In order to overcome such a problem, there has been proposed a method to introduce a polyester resin having a crosslinking structure into toner particles by coating the circumference of core particles via adhesion of polyester resin particles having a crosslinking structure to the core particles (for example, refer to patent document 4).

However, the aforementioned method disclosed by patent document 4 has a problem that the capable range of fixing temperature is narrow due to incorporation of toner particles having a lowered temperature causing high-temperature offset. This is because, when the polyester particles having a crosslinking structure are formed via a phase-transfer emulsification method, a crosslinking reaction has been already started at the moment when the oil phase is dispersed in an aqueous medium, because the oil phase liquid obtained by dissolving a polyester resin containing a polymerizable unsaturated bond in an organic solvent already contains a radical polymerization initiator, whereby the variation in the size of oil droplets formed from the oil phase or the variation in the crosslinking degree in each oil droplet becomes larger.

PATENT DOCUMENTS

Patent Document 1: Japanese Patent Application Publication Open to Public Inspection (hereafter referred to as JP-A) No. 2009-223281

Patent Document 2: JP-A No. 2008-262166

Patent Document 3: JP-A No. 2008-256913

Patent Document 4: JP-A No. 2010-55094

SUMMARY OF THE INVENTION

In view of the foregoing problems, the present invention was achieved. An object of the present invention is to provide a producing method of a toner for developing an electrostatic image, which enables stable production of a toner which forms fundamentally a high quality image and exhibits an excellent anti-high temperature offset property and an excellent high temperature storage property while exhibiting an excellent low temperature fixing property and further provides a moderate gloss to the formed image, as well as to provide an electrostatic image developing toner produced by the method.

One of the aspects to achieve the above object of the present invention is a method of producing an electrostatic image developing toner comprising toner particles comprising a binder resin containing at least a non-crystalline polyester resin having a crosslinking structure and a crystalline polyester resin, the method comprising the steps of:

(a-1) preparing an aqueous dispersion liquid of particles containing a crystalline polyester resin;

(a-2) preparing an aqueous dispersion liquid of particles containing a non-crystalline polyester resin having a polymerizable unsaturated bond, (b) preparing particles containing a non-crystalline polyester resin having a crosslinking structure by adding a radical polymerization initiator to the aqueous dispersion liquid of particles containing the non-crystalline polyester resin having a polymerizable unsaturated bond, (c) preparing core particles by aggregating at least the particles containing the crystalline polyester resin in an aqueous medium, and (d) preparing a shell layer containing the non-crystalline polyester resin having a crosslinking structure by fusing the particles containing the non-crystalline polyester resin having a crosslinking structure on surfaces of the core particles in an aqueous medium.

It is another aspect of the present invention that the electrostatic image developing toner of the present invention is produced by the above mentioned method of producing an electrostatic image developing toner.

DESCRIPTION OF THE PREFERRED EMBODIMENTS

According to the producing method of the toner of the present invention, since the crosslinking structure of the non-crystalline polyester resin particles having a crosslinking structure, the non-crystalline polyester resin particles forming the shell layer by being fused onto the core particles, is formed after the non-crystalline polyester having a polymerizable unsaturated bond is dispersed in an aqueous medium to form desired particles, the variation in the size or the crosslinking degree in the non-crystalline polyester resin particles is kept small and the obtained toner exhibits a sharp particle diameter distribution. As the result, a toner which forms fundamentally a high quality image and exhibits an excellent anti-high temperature offset property and an excellent high temperature storage property while exhibiting an excellent low temperature fixing property and further provides a moderate gloss to the formed image can be produced with a smaller energy.

The present invention will be concretely described.

[Toner Producing Method]

The producing method of a toner according to the present invention is a method to produce a toner containing a binder resin containing at least a non-crystalline polyester resin having a crosslinking structure (hereafter, also referred to as a crosslinking non-crystalline polyester resin) and a crystalline polyester resin, the method containing the steps of:

a step to prepare an aqueous dispersion liquid of particles containing a crystalline polyester resin (hereafter, also referred to as crystalline polyester resin particles);

a step to prepare an aqueous dispersion liquid of particles containing a non-crystalline polyester resin having a polymerizable unsaturated bond (hereafter, also referred to as an unsaturated non-crystalline polyester resin particles and unsaturated non-crystalline polyester resin particles);

a step to prepare particles containing a non-crystalline polyester resin having a crosslinking structure (hereafter, also referred to as crosslinking non-crystalline polyester resin particles) by adding a radical polymerization initiator to the aqueous dispersion liquid of particles containing the unsaturated non-crystalline polyester resin;

a step to prepare core particles by aggregating at least the particles containing the crystalline polyester resin in an aqueous medium; and a step to prepare a shell layer containing the crosslinking non-crystalline polyester resin by fusing the particles containing the crosslinking non-crystalline polyester resin on surfaces of the core particles in an aqueous medium.

A concrete example of such a producing method of a toner includes:

(1-A) a crystalline polyester resin particle dispersion liquid preparing step in which a crystalline polyester resin is synthesized and a dispersion liquid of crystalline polyester resin particles is prepared by using the crystalline polyester resin;

(1-B-1) an unsaturated non-crystalline polyester resin particle dispersion liquid preparing step in which an unsaturated non-crystalline polyester resin is synthesized, a non-crystalline polyester resin liquid in which the unsaturated non-crystalline polyester resin is dissolved or dispersed in an organic solvent is prepared, and a dispersion liquid of unsaturated non-crystalline polyester resin particles is prepared by forming oil droplets containing the unsaturated non-crystalline polyester resin particles in an aqueous medium, followed by removing the organic solvent;

(1-B-2) a crosslinking non-crystalline polyester resin particle dispersion liquid preparing step in which, in the unsaturated non-crystalline polyester resin particle dispersion liquid, crosslinking non-crystalline polyester resin particles are formed by applying a radical polymerization initiator to the polymerizable unsaturated bond of the unsaturated non-crystalline polyester resin to conduct radical polymerization, whereby a dispersion liquid of crosslinking non-crystalline polyester resin particles is prepared;

(1-C) a colorant particle dispersion liquid preparing step, according to the necessity, in which a dispersion liquid of particles of a colorant (hereafter, also referred to as colorant particles) is prepared by dispersing a colorant as particles in an aqueous medium;

(2) a core aggregation particles forming step in which, in an aqueous medium, core aggregation particles are formed by aggregating particles of toner components, for example, resin particles which construct a material of a binder resin, such as, crystalline polyester resin particles and, if necessary, non-crystalline polyester resin particles, colorant particles, releasing agent particles and charge control agent particles;

(3) an adhering step in which crosslinking non-crystalline polyester resin particles are adhered on the surfaces of the core aggregation particles to form core-shell aggregation particles;

(4) a fusing step in which obtained core-shell aggregation particles are fused to form toner particles;

(5) a filtering/washing step in which obtained toner particles are separated by filtration from the aqueous medium and, for example, the surfactant is removed by washing from the toner particles;

(6) a drying step of washed toner particles; and, if necessary, (7) an external additive providing step in which an external additive is provided to the dried toner particles.

(1-A) Crystalline Polyester Resin Particle Dispersion Liquid Preparing Step

In the crystalline polyester resin particle dispersion liquid preparing step, a crystalline polyester resin is synthesized and the crystalline polyester resin is dispersed in an aqueous medium as particles to form a dispersion liquid of the crystalline polyester resin particles.

In the present invention, the crystalline polyester resin is a polyester resin having definite endothermic peak but not stepwise endothermic change in differential scanning calorimetry (DSC). The crystalline polyester resin is not restricted as far as it has such characteristics described above, and includes, for example, a resin in which other component is copolymerized to a backbone of the crystalline polyester resin having definite endothermic peak as described above.

The melting point of the crystalline polyester resin used in the present invention is preferably 30-99° C. and more preferably 45-88° C. The melting point of the crystalline polyester resin indicates the temperature of the peak top at the crystalline polyester resin endothermic peak and can be measured, for example, by using "DSC-7 Differential Scanning calorimeter" (manufactured by PerkinElmer Inc.) or "TAC7/DX Thermal Analyzer Controller" (manufactured by PerkinElmer Inc.).

Specifically, 0.5 mg of a crystalline polyester resin is weighed accurately down to the second decimal place, is charged into an aluminum pan (KITNO. 0219-0041), is set in a DSC-7 sample holder, is subject to the temperature control of Heat-Cool-Heat under the condition of a measuring temperature of 0° C. to 200° C., a temperature rising speed of 10° C./minute, and a temperature falling speed of 10° C./minute, and is analyzed on the basis of the data at the second Heat. For reference measurement, an empty aluminum pan is used.

The crystalline polyester resin has preferably a number average molecular weight (Mn) of 100 to 10,000, more preferably 800 to 5,000, and a weight average molecular weight (Mw) of preferably 1,000 to 50,000, and more preferably 2,000 to 30,000, via a THF soluble part gel permeation chromatography.

Molecular determination via GPC is carried out as follows: namely, using apparatus "HLC-8220" (produced by Tosoh Corp.) and column "TSK guard column+TSK gel Super HZM-M (three in series)" (produced by Tosoh Corp.), as the column temperature is kept at 40° C., tetrahydrofuran (THF) as a carrier solvent is passed at a flow rate of 0.2 ml/min, and a measurement sample is dissolved in tetrahydrofuran so as for the concentration thereof to be 1 mg/ml under a condition in that dissolution is carried out using an ultrasonic dispersing device at room temperature for 5 minutes. Then a sample solution is obtained via treatment of a membrane filter of a 0.2 μm pore size, and 10 μl thereof is injected into the above apparatus along with the carrier solvent for detection using a refractive index detector (RI detector). Subsequently, the molecular weight of the measurement sample is calculated using a calibration curve wherein the molecular weight distribution of the sample is determined employing a monodispersed polystyrene standard particle. As the standard polystyrene sample used to obtain the calibration curve, there are employed any of those featuring a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$. The calibration curve is drawn by connecting at least 10 points obtained via measurement using the standard polystyrene sample. Further, as a detector, the reflective index detector is utilized.

The crystalline polyester resin can be formed of dicarboxylic acid component and diol component.

Aliphatic dicarboxylic acid is preferably usable as the dicarboxylic acid component, and aromatic dicarboxylic acid may be used in combination. As the aliphatic dicarboxylic acid straight chain type is preferably used. The dicarboxylic acid component is not limited to one species but two or more species may be used in combination.

Examples of aliphatic dicarboxylic acid include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,16-hexadecane dicarboxylic acid and 1,18-octadecane dicarboxylic acid. Lower alkyl esters or anhydride acids of these dicarboxylic acids may be employed. Adipic acid, sebacic acid and 1,10-decane dicarboxylic acid are preferably used among above described aliphatic dicarboxylic acids in view of easy availability.

Examples of aromatic dicarboxylic acid used with the aliphatic dicarboxylic acid include terephthalic acid, isophthalic acid, orthophthalic acid, t-butyl isophthalic acid, 2,6-naphthalene dicarboxylic acid and 4,4'-biphenyl dicarboxylic acid. Terephthalic acid, isophthalic acid and t-butyl isophthalic acid is preferably used among these in view of easy availability and easy emulsification property.

Amount of aromatic dicarboxylic acid to be used is preferably 20 mol % or less when the total amount of dicarboxylic acid component to form the crystalline polyester resin being 100 mol %, more preferably 10 mol % or less and preferably 5 mol % or less particularly.

In case that the amount of the aromatic dicarboxylic acid is 20 mol % or less, crystallinity of the crystalline polyester resin is maintained, excellent low temperature fixing property is obtained in the toner to be manufactured, and glossiness is obtained in the finally formed image, deterioration of image storage ability is inhibited due to lowering of melting point. And further, emulsion state is certainly obtained when oil droplets are formed by employing oil phase liquid containing the crystalline polyester resin.

It is preferable to used aliphatic diol as the diol component, and, according to necessity, diols other than aliphatic diol may be incorporated.

It is preferable to use straight-chain aliphatic diol having 2 to 22 carbon atoms for composing main chain among the aliphatic diols as a diol component, and in particular preferably straight-chain aliphatic diol having carbon 2 to 14 atoms for composing main chain in view of easy availability, exhibiting certain low temperature fixing property and obtaining high glossiness image.

When the straight-chain aliphatic diol having 2 to 22 carbon atoms for composing main chain is used, a polyester resin having a melting point at such a level as inhibiting low temperature fixing property is not formed, sufficient low temperature fixing property is obtained in toner to be manufactured, and glossiness is obtained in the finally formed image when aromatic dicarboxylic acid is used as the dicarboxylic acid component in combination.

Branched type of aliphatic diol may be used for diol component, and in this instance, it is preferable to use straight-chain aliphatic diol in combination and content ratio of the straight-chain aliphatic diol is made higher in view of obtaining certain crystallinity. When the content ratio of used straight-chain aliphatic diol is higher, crystallinity is obtained certainly and excellent low temperature fixing property is obtained in toner to be manufactured, a deterioration of image storage ability due to lowering melting point is inhibited, and further anti-blocking property can be obtained certainly in the image finally formed.

The diol component is not limited to one species but two or more species nay used in mixture.

It is preferable to use content of aliphatic diol is set as 80 mol % or more in the diol component to form the crystalline polyester resin, and more preferably 90 mol % or more. When the diol component content of aliphatic diol is 80 mol % or more, crystallinity of the crystalline polyester resin is obtained certainly and excellent low temperature fixing property is obtained in toner to be manufactured and glossiness is obtained in the image finally formed.

Examples of aliphatic diol include ethylene glycol, 1,3-propanediol, 1,4-butanediol, 1,5-pentane glycol, 1,6-hexane glycol, 1,7-heptane glycol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol and 1,20-eicosanediol, and it is preferable to use ethylene glycol, 1,4-butanediol, 1,6-hexane glycol, 1,9-nonanediol and 1,10-decanediol, among them.

Examples of diol other than aliphatic diol include diols having a double bond and diols having a sulfonic acid group, specifically, 2-butene-1,4-diol, 3-hexene-1,6-diol and 4-octene-1,8-diol are listed for the dials having a double bond.

Content ratio of the diols having a double bond in the diol component is preferably 20 mol % or less and more preferably 2 to 10 mol %. When the content ratio of the diols having a double bond in the diol component is 20 mol % or less, melting point of the polyester resin to be obtained is not so much lowered, and therefore, there is small probability to generate filming.

Content ratio of the dicarboxylic acid component to diol component as used is preferably made so that equivalent ratio of hydroxyl group [OH] in diol component to carboxyl group [COOH] in dicarboxylic acid component [OH]/[COOH] is 1.5/1 to 1/1.5, and more preferably 1.2/1 to 1/1.2.

When the content ratio of dicarboxylic acid component to diol component as used is satisfies the range as above described, a crystalline polyester resin having expected molecular weight can be obtained certainly.

As a method to disperse a crystalline polyester resin in an aqueous medium, cited is a method to dissolve or disperse the crystalline polyester resin in an organic solvent to form a crystalline polyester resin liquid, and to disperse the crystalline polyester resin liquid in an aqueous medium via, for example, a phase-transfer emulsification method, to form oil droplets having a desired diameter, followed by removing the organic solvent.

The aqueous medium refers to a medium containing water in an amount of at least 50% by mass. As components other than water are cited water-soluble organic solvents and examples thereof include methanol, ethanol, isopropanol, butanol, acetone, methyl ethyl ketone and tetrahydrofuran. Of these solvents, it is preferred to use organic solvents which do not dissolve a resin, for example, alcoholic solvents such as methanol, ethanol, isopropanol and butanol.

The amount of the aqueous medium is preferably from 50 to 2,000 parts by mass and more preferably from 100 to 1,000 parts by mass, based on 100 parts by mass of crystalline polyester resin solution.

An amount of the aqueous medium, falling within the foregoing range can achieve the desired particle size of emulsifying dispersion of the crystalline polyester resin in the aqueous medium.

A dispersion stabilizer may be dissolved in the aqueous medium. Further, surfactants or resin particles may also be added to the aqueous medium to achieve enhanced dispersion stability of oil-droplets.

Examples of a dispersion stabilizer include inorganic compounds such as tricalcium phosphate, calcium carbonate, titanium oxide, colloidal silica and hydroxy-apatite. Of these, an acid- or alkali-soluble dispersion stabilizer such as tricalcium phosphate is preferred in terms of necessity of removing the dispersion stabilized from the obtained colored particles and the use of an enzyme-degradable one is preferred in terms of environment concern.

Exemplary surfactants include anionic surfactants such as alkylbenzenesulfonate, α-olefin sulfonate, and phosphoric acid ester; cationic surfactants including an amine salt type such as an alkylamine salt, an aminoalcohol fatty acid derivative, and a quaternary ammonium alt type such as alkyltrimethylammonium, a dialkyldimethylammonium salt, an alkyldimethylbenzyl ammonium salt, a pyridinium salt, an alkylisoquinolinium and benzethonium chloride; nonionic surfactants such as fatty acid amide derivatives, polyol derivatives; amphoteric surfactants such as alanine, dodecyl-di-(aminoethyl)glycine, di(octylaminoethyl)glycine and N-alkyl-N,N-dimethylammonium betaine. Anionic or cationic, fluoroalkyl-containing surfactants are also usable.

It is preferable that particle diameter of the resin microparticles is 0.5 to 3 μm for improving dispersion stability, and specifically, methyl polymethacrylate resin microparticles having particle diameter of 1 μm and 3 μm, polystyrene resin microparticles having particle diameter of 0.5 μm and 2 μm, and polystyrene acrylonitrile resin microparticles having particle diameter of 1 μm are listed.

As an organic solvents used for the preparation of the crystalline polyester resin liquid, preferable is an organic solvent having a low boiling point and a low solubility in water in view of easy removal from the oil droplet after it is formed. Concrete examples of such an solvent include methyl acetate, ethyl acetate, methyl ethyl ketone, methyl isobutyl ketone, toluene and xylene, which may be used singly or in combination of two or more kinds. Such an organic solvent is used preferably in an amount of 1 to 300 parts by mass, more preferably 1 to 100 parts by mass, and still more preferably 25 to 70 parts by mass, based on 100 parts by mass of crystalline polyester resin.

Emulsifying dispersion of the crystalline polyester resin liquid can be carried out using mechanical energy. Homogenizers to perform emulsifying dispersion are not specifically limited, and include a low-speed shearing homogenizer, a high-speed shearing homogenizer, a friction-type homogenizer, a high-pressure jet homogenizer, and an ultrasonic homogenizer. Specifically, "T.K. Homomixer" (produced by Tokushu Kika Kogyo Co., Ltd.) is exemplified.

The volume median diameter of the oil droplets in the dispersed state is preferably 50-400 nm and more preferably 80-200 nm.

The volume median diameter of the oil droplets can be measure using electrophoretic light scattering spectrophotometer "ELS-800" (produced by Otsuka Electronics Co., Ltd.).

The organic solvent removal treatment after oil droplets are formed is carried out by the operation, namely, the whole part of the dispersion in which the crystalline polyester resin particles are dispersed in an aqueous medium is gradually heated while stirring in a laminar flowing state and strongly stirred at a prescribed temperature range, and then subjected to a solvent removal treatment. When the crystalline polyester resin particles are formed by using the dispersion stabilizer, an acid or alkali is added to remove the dispersion stabilizer in addition to the organic solvent removal treatment.

(1-B-1) Unsaturated Non-Crystalline Polyester Resin Particle Dispersion Liquid Preparing Step This preparation step of unsaturated non-crystalline polyester resin particle dispersion liquid is a step to synthesize an unsaturated non-crystalline polyester resin for obtaining a crosslinking non-crystalline polyester resin which is a raw material of a binder resin to compose toner particles and to disperse the unsaturated non-crystalline polyester resin particles in an aqueous medium as particles to obtain an unsaturated non-crystalline polyester resin particle dispersion liquid.

In the present invention, a non-crystalline polyester resin means a resin which contains a polymerizable unsaturated bond which can be subjected to radical polymerization, and usually does not have a melting point, which is different from the aforementioned crystalline polyester resin, but has a relatively high glass transition point temperature.

The unsaturated non-crystalline polyester resin can be synthesized by employing a polyalcohol and a polycarboxylic acid at least one of which has a polymerizable unsaturated double bond in the same synthesis step as above described crystalline polyester resin.

The polyalcohol and polycarboxylic acid at least one of which has a polymerizable unsaturated bond mean any one of combinations of, (1) polyalcohols all or part of which have a polymerizable unsaturated bond and polycarboxylic acid having no polymerizable unsaturated bond, (2) polyalcohols having no polymerizable unsaturated bond and polycarboxylic acids all or part of which have a polymerizable unsaturated bond, and (3) polyalcohols all or part of which have a polymerizable unsaturated bond and polycarboxylic acids all or part of which have a polymerizable unsaturated bond.

The glass transition point temperature (Tg) of the unsaturated non-crystalline polyester resin is preferably 20 to 90° C., and in particular 35 to 65° C. is more preferable.

The softening point of the unsaturated non-crystalline polyester resin is preferably from 70 to 220° C., more preferably from 80 to 180° C.

Herein, the glass transition temperature (Tg) of the unsaturated non-crystalline polyester resin is determined using differential scanning calorimeter DSC-7 (produced by Perkin Elmer, Inc.) and thermal analyzer controller "TAC7/DX" (produced by Perkin Elmer, Inc.). Specifically, 4.50 mg of the unsaturated non-crystalline polyester resin is sealed in an aluminum pan (Kit No. 0219-0041) and placed in a DSC-7 sample holder. An empty aluminum pan is used as the reference measurement. Subsequently, heating-cooling-heating temperature control is carried out over a measurement temperature range of 0 to 200° C. under measurement conditions of a temperature increasing rate of 10° C./min and a temperature decreasing rate of 10° C./min. Measured data is obtained from the second heating stage, and then a glass transition point (Tg) is obtained as a temperature which is read at the intersection of the extension of the base line before the initial rise of the first endothermic change, and the tangent showing the maximum inclination in the curve of the first endothermic change just after the initial rise. In this instance, during the first temperature increase, temperature is kept at 200° C. for 5 minutes.

The softening point is determined as follows: at first, 1.1 g of the unsaturated non-crystalline polyester resin is placed in a Petri dish at ambiences of 20° C. and 50% RH, followed by being made even and by being allowed to stand for at least 12 hours, and thereafter a pressed sample of a 1 cm diameter columnar shape is prepared via compression at a compression pressure of 3,820 kg/cm$^2$ for 30 seconds using press instrument SSP-10A (produced by Shimadzu Corp.). Subsequently, using flow tester CFT-500D (produced by Shimadzu Corp.) at ambiences of 24° C. and 50% RH, the pressed sample is extruded through the columnar die orifice (1 mm diameter×1 mm) by use of a 1 cur diameter piston, starting at the time of the termination of preheating, under conditions of a weight of 196 N (20 kgf), an initial temperature of 60° C., preheating duration of 300 seconds, and a temperature increasing rate of 6° C./min. An offset method temperature $T_{offset}$, measured at an offset value of 5 mm via the melt temperature measurement method, being a temperature increasing method, is designated as the softening point.

The unsaturated non-crystalline polyester resin has a number average molecular weight (Mn) in terms of gel permeation chromatography (GPC) of component soluble in THF of preferably 1,000 to 15,000, and more preferably 1,500 to 10,000. Weight average molecular weight (Mw) is preferable 2,000 to 50,000, and more preferably 3,000 to 30,000.

Measurement of molecular weight by GPC is conducted in a similar way as the measurement of molecular weight of crystalline polyester resin except that the component soluble in THF of an unsaturated non-crystalline polyester resin is used as the sample to be measured.

Polyalcohol used for forming an unsaturated non-crystalline polyester resin includes, in addition to above described aliphatic diols, for example, bisphenols such as bisphenol A and bisphenol F, and alkylene oxide adduct of the bisphenol with ethyleneoxide adduct and propylene oxide adduct. Tri or more valent polyalcohols include glycerin, trimethylolpropane, pentaerythritol and sorbitol. Further, it is preferable to used cyclohexane diol and neopentyl alcohol in view of production cost or influence to environment. These may be uses single or plural in combination.

When unsaturated bond in the unsaturated non-crystalline polyester resin is introduced from polyalcohol, polyalcohol having a polymerizable unsaturated bond, specifically, alkene diol such as 2-buten-1,4-diol, 3-hexen-1,6-diol and 4-octadecene-1,8-diol are used as the polyalcohol to form an unsaturated non-crystalline polyester resin. These may be used single or plural in combination.

Polycarboxylic acid used to form the unsaturated non-crystalline polyester resin includes, in addition to the above described dicarboxylic acid, three or more valent polycarboxylic acid such as trimellitic acid and pyromellitic acid may be used These may be used singly or plural in combination.

When unsaturated bond in the unsaturated non-crystalline polyester resin is introduced from polycarboxylic acid, polycarboxylic acid having a polymerizable unsaturated bond, specifically, unsaturated aliphatic dicarboxylic acid such as maleic acid, fumaric acid, itaconic acid, citraconic acid, glutaconic acid, isododecylsuccinic acid, n-dodecenyl succinic acid and n-octenyl succinic acid; as well as acid anhydride or acid chloride thereof may be used. Further, a small amount of monocarboxylic acid having an unsaturated bond such as coffee acid may also be used. These may be used single or plural in combination.

As a method to disperse an unsaturated non-crystalline polyester resin in an aqueous medium, similarly to the method to disperse a crystalline polyester resin in an aqueous medium, cited is a method to dissolve or disperse the unsaturated non-crystalline polyester resin in an organic solvent to form a non-crystalline polyester resin liquid, and to disperse the non-crystalline polyester resin liquid in an aqueous medium via, for example, a phase-transfer emulsification method, to form oil droplets having a desired diameter, followed by removing the organic solvent.

It is preferable that the oil droplets have a volume median diameter of 50-400 nm and more preferably 80-200 nm.

(1-B-2) Preparation Step of Crosslinking Non-Crystalline Polyester Resin Particle Dispersion Liquid In the step to generate a crosslinking non-crystalline polyester resin particle dispersion liquid, a radical polymerization initiator is added to the unsaturated non-crystalline polyester resin particle dispersion liquid to conduct a radical polymerization reaction of the unsaturated bond contained in the unsaturated non-crystalline polyester resin particles to form a crosslinking structure, whereby a crosslinking non-crystalline polyester resin particle dispersion liquid containing a crosslinking non-crystalline polyester resin which is a component exhibiting high elasticity is obtained.

An arbitrary radical polymerization initiator is usable as far as it is a water soluble polymerization initiator. Examples of a concrete polymerization initiator include: water soluble azo polymerization initiators such as 2,2'-azobis[2-(2-imidazoline-2-yl)propane]di-hydrochloric acid salt, 2,2'-azobis[2-(2-imidazoline-2-yl)propane]di-sulfuric acid salt anhydride, 2,2'-azobis(2-methylpropion amidine) di-hydrochloric acid salt, 2,2'-azobis[N-(2-carboxyethyl)-2-methylpropion amidine] hydrate, 2,2'-azobis[2-(2-imidazoline-2-yl)propane]di-hydrochloric acid salt, 2,2'-azobis[2-(2-imidazoline-2-yl) propane]di-sulfuric acid anhydride, 2,2'-azobis (1-imino-1-pyrrolidino2-ethylpropane) di-hydrochloric acid salt, 2,2'-azobis {2-methyl-N-[1,1-bis(hydroxy methyl)-2-hydroxyethyl]propionamide} and 2,2'-azobis[2-methyl-N-(2-hydroxyethyl) propionamide]; water soluble polymerization initiators such as persulfates such as potassium persulfate and ammonium persulfate, azobis amino dipropane acetic acid salt, azobis cyano valerianic acid and their salts and hydrogen peroxide. These may be used singly or two or more in combination.

(Chain Transfer Agent)

In the crosslinking non-crystalline polyester resin particle dispersion liquid preparation step, generally known chain transfer agents can be used for the purpose of adjusting the molecular weight of the crosslinking non-crystalline polyester resin. The chain transfer agents are not limited in particular. Examples thereof include: 2-chloroethanol; mercaptans such as octyl mercaptan, dodecyl mercaptan, and t-dodecyl mercaptan; and a styrene dimer.

The glass transition point temperature (Tg) of the crosslinking non-crystalline polyester resin is preferably 35 to 90° C., and in particular 45 to 75° C. is more preferable.

The softening point of the crosslinking non-crystalline polyester resin is preferably from 80 to 150° C., more preferably from 90 to 110° C.

The glass transition point temperature (Tg) and the softening point of the crosslinking non-crystalline polyester resin are determined in the same manner as the determination of the glass transition point temperature and the softening point of the unsaturated non-crystalline polyester resin except that a crosslinking non-crystalline polyester resin is used as a measuring sample.

Further, the number average molecular weight (Mn) of the crosslinking non-crystalline polyester resin is preferably 1,000-30,000, more preferably 2,000-20,000, and the weight average molecular weight (Mw) thereof is preferably 3,000-100,000, more preferably 5,000-80,000, which are determined for a THF soluble part via gel permeation chromatography (GPC).

The measurement of the molecular weight via GPC is carried out in the same manner as the measurement of the molecular weight of the crystalline polyester resin except that a THF soluble part of a crosslinking non-crystalline polyester resin is used as a measuring sample.

(1-C) Preparation Step of Colorant Particle Dispersion Liquid

This preparation step of colorant particle dispersion liquid is carried out, if necessary, when toner particles containing a colorant is desired. and it is a step in which a colorant is dispersed in an aqueous medium as particles to prepare a dispersion liquid of colorant particles

[Colorant]

Commonly known dyes and pigments may be used as the colorant.

Various known materials may be used optionally for the colorant for black toner, for example, carbon black such as furnace black and channel black, magnetic material such as magnetite and ferrite, a dye, an inorganic pigment containing non-magnetic iron oxide.

Various known materials may be used for the colorant for color toners, including a dye and an organic pigment optionally. Specifically include organic pigments such as C.I. Pigment Red 5, Pigment Red 48:1, Pigment Red 53:1, Pigment Red 57:1, Pigment Red 81:4, Pigment Red 122, Pigment Red 139, Pigment Red 144, Pigment Red 149, Pigment Red 166, Pigment Red 177, Pigment Red 178, Pigment Red 222, Pigment Red 238, Pigment Red 269; C.I. Pigment Yellow 14, Pigment Yellow 17, Pigment Yellow 74, Pigment Yellow 93, Pigment Yellow 94, Pigment Yellow 138, Pigment Yellow 155, Pigment Yellow 180, Pigment Yellow 185; C.I. Pigment Orange 31, Pigment Orange 43; C.I. Pigment Blue 15;3, Pigment Blue 60, Pigment Blue 76, and dyes such as C.I Solvent Red 1, Solvent Red 49, Solvent Red 52, Solvent Red 58, Solvent Red 68, Solvent Red 11, Solvent Red 122; C.I. Solvent Yellow 19, Solvent Yellow 44, Solvent Yellow 77, Solvent Yellow 79, Solvent Yellow 81, Solvent Yellow 82, Solvent Yellow 93, Solvent Yellow 98, Solvent Yellow 103, Solvent Yellow 104, Solvent Yellow 112, Solvent Yellow 162, C.I. Solvent Blue 25, Solvent Blue 36, Solvent Blue 69, Solvent Blue 70, Solvent Blue 93 and Solvent Blue 95.

Colorants may be used one or two or more species in combination for obtaining respective color.

The dispersion of a colorant can be conducted using a mechanical energy.

The volume median diameter of the colorant particles in the dispersed state is preferably 10-300 nm, more preferably 100-200 nm, and specifically preferably 100-150 nm.

The volume median diameter of the colorant particles can be measure using electrophoretic light scattering spectrophotometer "ELS-800" (produced by Otsuka Electronics Co., Ltd.).

(2) Core Aggregation Particle Preparation Step

This core aggregation particle preparation step is a step in which crystalline polyester resin particles, non-crystalline polyester resin particles and colorant particles are aggregated to form core aggregation particles by allowing these particles to slowly aggregate by taking a balance between a repulsion force of the surface of the particle by adjusting a pH value and an aggregation force caused by addition of an aggregating agent composed of an electrolyte, in a reaction system containing a crystalline polyester resin particle dispersion liquid, a colorant particle dispersion liquid, if necessary, a non-crystalline polyester resin particle dispersion liquid, and a dispersion liquid of other toner constituting component.

In the core aggregation particle preparation step, a surfactant may be added in the aqueous medium to stably disperse each particle in the reaction system.

Such a surfactant is not specifically limited and those well known in the art are usable, examples of which include:

The surfactants are not limited in particular, and well-known various surfactants may be used. Suitable examples of the surfactants include: salts of sulfonic acid, such as sodium dodecyl benzene sulfonate and sodium aryl alkyl polyether sulfonate; salts of sulfonic acid ester, such as sodium dodecyl sulfate, sodium tetradecyl sulfate, sodium pentadecyl sulfate, and sodium octyl sulfate; and ionic surfactants of fatty acid salts, such as sodium oleate, sodium laurate, sodium caprate, sodium caprylate, sodium caproate, potassium stearate, and calcium oleate.

In addition, the following nonionic surfactants can also be used: polyethylene oxide, polypropylene oxide, combination of polypropylene oxide and polyethylene oxide, ester of polyethylene glycol and higher fatty acid, alkylphenol polyethylene oxide, ester of higher fatty acid and polyethylene glycol, ester of higher fatty acid and a polypropylene oxide, and sorbitan ester.

As an aggregating agent usable in the core aggregation particle preparation step, for example, metal salts of monovalent, divalent or trivalent may be cited. Examples of a metal which constitutes an aggregation agent include: alkali metals such as lithium, potassium and sodium; alkaline earth metals such as magnesium, calcium, strontium and barium; and aluminum. Examples of a counter ion (namely, an anion to form a salt) include: a chloride ion, a bromide ion, an iodide ion, carbonate ion and a sulfate ion.

In the present invention, the resin which constitutes a binder resin contained in the core aggregation particles may contain at least a crystalline polyester resin, and a non-crystalline polyester resin or other resin may further be contained.

The non-crystalline polyester resin contained in the core aggregation particles may be one which contains a polymerizable unsaturated bond, one which contains no polymerizable unsaturated bond, or one which contains a crosslinking non-crystalline polyester resin.

Namely, in the obtained toner, the binder resin may contain at least a crystalline polyester resin liquid and a crosslinking non-crystalline polyester resin, and, according to the necessity, a non-crystalline polyester resin having or not having a polymerizable unsaturated bond or other resin may be contained.

When non-crystalline polyester resin particles are added in the core aggregation particles preparation step, the relative mixing ratio of crystalline polyester resin particle dispersion liquid:non-crystalline polyester resin particle dispersion liquid is preferably 2:98-70:30 and more preferably 10:90-50:50 in mass ratio of the solid content.

In the core aggregation particles preparation step, the adding amount of colorant particles in the reaction system is preferably 1-12 parts by mass and more preferably 2-8 parts by mass of the colorant particles in 100 parts by mass of the binder resin. When the adding amount of the colorant particles is less than 1 part by mass of the colorant particles in 100 parts by mass of the binder resin, no desired coloring effect may be obtained. Alternatively, when the adding amount of the colorant particles is more than 12 parts by mass of the colorant particles in 100 parts by mass of the binder resin, isolation or adhesion to the carrier of the colorant may occur, whereby affecting the charging property.

When an internal additive such as a releasing agent or a charge control agent is incorporated in the toner particles, a internal additive particle dispersion liquid containing only a colorant is prepared prior to the core aggregation particles preparing step (2) and the internal additive particle dispersion liquid is mixed with the crystalline polyester resin particle dispersion liquid or colorant particle dispersion liquid in the core aggregation particles preparing step (2).

Or the internal additive may be incorporated in the toner particles, for example, by mixing the internal additive with the crystalline polyester resin or non-crystalline polyester resin in the Crystalline polyester resin particle dispersion liquid preparing step (1-A) or Unsaturated non-crystalline polyester resin particle dispersion liquid preparing step (1-B-1).

[Releasing Agent]

The releasing agents are not limited in particular, and well-known various releasing agents may be used.

Examples of concrete releasing agents include: low molecular weight polyolefin waxes such as polyethylene, polypropylene and polybuten; synthetic ester waxes; vegetable waxes such as carnauba wax, rice wax, candelilla wax, Japanese wax and jojoba wax; mineral waxes and petroleum waxes such as montan wax, paraffin wax, microcrystalline wax, and Fischertropush wax; and modified waxes thereof.

[Charge Control Agent]

Various well-known compounds can be used as a charge control agent.

The adding amount of a charge control agent is usually 0.1-10 parts by mass and preferably 0.5-5 parts by mass in 100 parts by mass of a binder resin contained in finally obtained toner particles.

(2-2) Shape Controlling Step

In the production method of the toner of the present invention, after the aforementioned core aggregation particle preparation step, a shape controlling step may be conducted, in which the shape of the finally obtained toner particles is controlled by controlling the shape of the core aggregation particles.

In the shape control treatment, a dispersion of the obtained core aggregation particles is subjected to filtering through a micrometer-order filter or a treatment of stirring in an annular type continuous-stirring mill to perform shape control so that the major/minor axis ratio falls within the prescribed range.

The concrete method of the shape controlling step of the toner particles includes a method in which toner particles are passed through gap, filter or pore, or centrifugal force is applied to the toner particles by a high speed rotation. The concrete shape control device for the core aggregation particles includes a piston type high pressure homogenizer and inline screw pump in addition to the above described an annular type continuous-stirring mill.

Desired shape of core aggregation particles is realized by controlling the factors regarding the shape controlling treatment such as treatment period, treatment temperature and treatment speed of toner shape control step.

Thus the shape of toner particles is controlled and the toner particles having predetermined range of ratio of long axis to short axis are obtained.

Herein, shape control treatment may be conducted after the adhering step which will be described later.

(3) Adhesion Step

This adhesion step is a step in which core-shell aggregation particles are formed by adhering the crosslinking non-crystalline polyester resin particles on the surfaces of the core aggregation particles, which is concretely conducted by adding a crosslinking non-crystalline polyester resin particle dispersion liquid into a reaction system in which core aggregation particles are dispersed in an aqueous medium under existence of an aggregating agent.

In the adhering step, the aggregating agent used in the aforementioned "Core aggregation particle preparation step (2)" can be subsequently used, and, therefore, it is not necessary to further add an aggregating agent. However, an aggregating agent may also be added in order to control the adhering speed of the crosslinking non-crystalline polyester resin particles. As usable aggregating agent, those usable in the "Core aggregation particle preparation step (2)" may be cited.

The adding amount of the crosslinking non-crystalline polyester resin particles into the reaction system in the adhering step is preferably 5-50 parts by mass and more preferably 10-40 parts by mass of the crosslinking non-crystalline polyester resin particles in total 100 parts by mass of the crystalline polyester resin particles and the unsaturated non-crystalline polyester resin particles.

(4) Fusing Step

The fusing step is a step, in which particles constituting core-shell aggregation particles are fused to obtain toner particles which contains core particles containing at least a crystalline polyester resin and shell layers containing a crosslinking non-crystalline polyester resin, by heating the reaction system at a temperature higher than either of the glass transition point temperatures of the crosslinking non-crystalline polyester resin particles and the crystalline polyester resin particles and higher than the melting point of the crystalline polyester resin particles.

(5) Filtration and Washing Step:

In the step, the toner particle dispersion obtained in the previous step is cooled and subjected to a filtration treatment in which the toner particle dispersion is filtered for solid-liquid separation to separate the toner particles from the dispersion and a washing treatment to remove adhered materials such a surfactant from the separated toner particles. Specific methods for solid-liquid separation and washing include, for example, centrifugal separation, filtration under reduced pressure by using Buchner's funnel and filtration using a filter press.

(6) Drying Step:

In the drying step, the toner particles having been washed are subjected to a drying treatment. Drying machines usable in this drying step include, for example, a spray dryer, a vacuum freeze dryer, a vacuum dryer, a standing plate type dryer, a mobile plate type dryer, a fluidized-bed dryer, a rotary dryer and a stirring dryer. The moisture content of the thus dried colored particles is preferably not more than 5% by mass, and more preferably not more than 2% by mass.

The moisture content of colored particles is determined by Karl Fischer coulometric titration. Specifically, using an automatic heat-vaporization moisture measurement system AQS-724 (produced by Hiranuma Sangyo Co., Ltd.) constituted of a moisture meter AO-6 AQI-601 (interface for AQ-6) and a heat-vaporization device LE-24S, 0.5 g of colored particles which has been allowed to stand in an atmosphere of 20° C. and 50% RH for 24 hrs. is precisely weighed and placed into a 20 ml glass tube and sealed with Teflon-coated silicone rubber packing. The moisture content under the sealed environment is measured using reagents under the conditions described below. Two empty sample tubes are concurrently measured to correct the moisture content under the sealed environment.

Sample heating temperature: 110° C.

Sample heating time: 1 min.

Nitrogen gas flow rate: 150 ml/min

Reagent:

Opposing electrode liquid (cathode liquid);

HYDRANAL—Coulomat CG-K

Generating liquid (anode liquid);

HYDRANAL® Coulomat AK

When the toner particles subjected to drying treatment form agglomerate by weak attracting force between particles, the agglomerate may be subjected to shredding treatment. A mechanical type of shredder such as jet mill, Henschel mixer, a coffee mill and a food processor may be used as the shredder.

(7) External Additive Addition Step:

In the external additive addition step, a charge controlling agent, various organic or inorganic microparticles and a lubricant are added to the dried toner particles to improve fluidity or an electrostatic property and to enhance cleaning capability. Examples of a device used for adding external additives include a turbulent mixer, a Henschel mixer, a Nauta mixer or a V-type mixer.

For instance, inorganic particles of silica, titania or alumina are preferably used and preferably, these inorganic particles are subjected to a treatment for hydrophobicity, using a silane coupling agent or a titanium coupling agent. External additives are incorporated preferably in an amount of 0.1 to 5.0% by mass of the toner, and more preferably 0.5 to 4.0% by mass. External additives may be used singly or in combination.

According to the aforementioned producing method, since the crosslinking structure of the non-crystalline polyester resin particles having a crosslinking structure, the non-crystalline polyester resin particles forming the shell layer by being fused onto the core particles, is formed after the non-crystalline polyester having a polymerizable unsaturated bond is dispersed in an aqueous medium to form desired particles, the variation in the size or the crosslinking degree in the non-crystalline polyester resin particles is kept small and the obtained toner exhibits a sharp particle diameter distribution. As the result, a toner which forms fundamentally a high quality image and exhibits an excellent anti-high temperature offset property and an excellent high temperature storage property while exhibiting an excellent low temperature fixing property and further provides a moderate gloss to the formed image can be produced with a smaller energy.

The glass transition point (Tg) of the toner obtained according to the aforementioned production method is preferably from 30 to 60° C., and more preferably from 35 to 55° C., and the softening point is preferably from 70 to 140° C. and more preferably from 80 to 135° C.

The glass transition point (Tg) and the softening point are measured by using a toner as a sample, similarly to the manner as described earlier.

[Diameter of Toner Particles]

The volume median diameter of the toner particles obtained by a producing method as described above is preferably 3 to 8 μm. The diameter of the toner particles can be controlled by the concentration of the aggregating agent in the core aggregation particles preparing step, the duration of fusing, and the composition of polyester resin. By adjusting the volume median diameter of the toner within the range of 3 to 8 μm, the ratio of toner particles having a larger adhesive force is decreased, and the transfer efficiency becomes higher, whereby the quality of a halftone image is improved, and the quality of a thin line image or a dot image is improved. When the adhesive force of a toner is large, the toner fries to adhere to the heating member resulting in causing fixing offset.

With respect to the diameter distribution of the toner, the CV value of the toner is preferably from 12 to 25, and more preferably from 15 to 20.

The CV value is obtained by the following Scheme (x). Herein, arithmetic mean particle diameter is a volume based mean value of particle diameter x of 25,000 toner particles, and the arithmetic mean particle diameter is measured via Coulter Multisizer 3, (manufactured by Beckmann Coulter Co.).

$$\text{CV value}(\%)=\{(\text{standard deviation})/(\text{arithmetic mean particle diameter})\}\times 100 \qquad \text{Scheme (x)}$$

The volume-based median diameter ($D_{50}$) of toner particles can be determined using Coulter Multisizer 3 (Beckmann Coulter Co.), connected to a computer system for data processing.

The measurement procedure is as follows: 0.02 g of toner particles are added to 20 ml of a surfactant solution (for example, a surfactant solution obtained by diluting a surfactant containing neutral detergent with pure water to a factor of 10) and dispersed in an ultrasonic homogenizer to prepare toner dispersion. Using a pipette, the toner dispersion is placed into a beaker containing ISOTON II (produced by Beckman Coulter Co.) within a sample stand, until reaching a measurement concentration of 7%. The measurement particle count number was set to 25000 to perform measurement. Then aperture diameter of the Multisizer 3 was 50 μm. The measurement range of 1 to 30 μm was divided into 256 portions to determine the frequency number. A particle size corresponding to 50% of the volume-integrated fraction from the larger particles was defined as a volume median diameter.

[Average Circularity of Toner Particles]

In the toner obtained by the producing method, the average circularity of toner particles is preferably in the range of 0.930 to 0.995, and more preferably 0.945 to 0.990, in view of improving transfer efficiency.

When the average circularity meets the range of 0.930 to 0.995, high filling density of toner particles in a toner layer transferred to the recording material is obtained and therefore improved fixing property is obtained and fixing offset tends not occur. Further respective toner particle is hard to break, stain of friction charge giving member is reduced and chargeability of the toner is stabilized.

The circularity of toner particles can be determined using FPIA-2100 (produced by Sysmex Co.). Concretely, toner particles are added into an aqueous surfactant solution, dispersed ultrasonically for 1 min. and subjected to measurement using FPIA-2100. The measurement condition is set to HPF (high power flow) mode and measurement is conducted at an optimum concentration of the HPF detection number of 3,000 to 10,000. The circularity of a particle is determined according to the following Scheme (y), circularities of toner particles are summed and divided by the number of total particles to obtain the circularity of the toner particles:

Reproducibility can be obtained when HPF detection number, satisfies the above described range.

Circularity={(circumference of a circle having an area equivalent to the projected area of a particle)/(circumference of the projected particle)}. Scheme (y)

[Developer]

When using the toner of the invention as a single-component developer by incorporating a magnetic material or as a two-component developer by mixing a so-called carrier, a nonmagnetic toner can be used alone, and the toner is suitably applied in either case.

There are usable known materials as a carrier constituting a two-component developer, including, for example, metals such as iron, ferrite and magnetite, and alloys of metals such as aluminum. Of these, ferrite particles are preferred.

The volume-average particle size of a carrier is preferably from 15 to 100 μm, and more preferably 25 to 60 μm. The volume-average particle size of the carrier can be determined using a laser diffraction type particle size distribution measurement apparatus provided with a wet disperser, HELOS (produced by SYMPATEC Corp.).

Preferred carriers include resin-coated carrier in which the surface of magnetic particles is covered with resin and a resin dispersion type carrier in which magnetic particles are dispersed in resin. Resins constituting the resin coated carrier are not specifically limited but an olefin resin, a styrene resin, a styrene/acryl resin, a silicone resin, an ester resin, or a fluorine-containing polymer resin is usable. Resins constituting the resin dispersion type carrier are not specifically limited but a styrene/acryl resin, a polyester resin, a fluororesin, or a phenol resin is usable.

[Image Forming Method]

The toner described above is suitable in an image forming method including a fixing step by a contact heating system. In this image forming method, an electrostatic latent image which has been electrostatically formed on an image bearing body is developed by allowing the developer to be electrostatically charged by a frictional-charging member in a developing device to obtain a toner image and the obtained toner image is transferred onto a recording material, thereafter, the transferred toner image is onto the recording material fixed by a contact-heating system to obtain a visible image.

Embodiments of the invention have been described but are not limited to these and various changes and modification can be made therein.

EXAMPLES

The present invention will be further described with reference to examples, however, the present invention is not limited thereto.

Synthesis Example of Unsaturated Non-Crystalline Polyester Resin A

Into a reaction vessel equipped with a stirring device, a nitrogen inlet pip; a temperature sensor and a rectifying column, the following materials were charged:

polycarboxylic acid components of 12 parts by mass of itaconic acid as, 70 parts by mass of terephthalic acid and 10 parts by mass of isophthalic acid; and polyalcohol components of 150 parts by mass of 2,2-bis (4-hydroxy phenyl) propane propylene oxide 2 mol adduct and 50 parts by mass of 2,2-bis(4-hydroxy phenyl)propane ethylene oxide 2 mol adduct.

Temperature within the system was raised to 190° C. taking one hour, after affirming that the inside of the system was stirred uniformly, catalyst Ti $(OBu)_4$ in an amount of 0.006% by mass based on the total amount of polycarboxylic acid, temperature within the system was raised to 240° C. taking 6 hours while removing generated water by distillation, and polymerization reaction was conducted by continuing dehydration condensation reaction for 6 hours maintaining the temperature, and an unsaturated non-crystalline polyester resin (A) was obtained. Thus obtained unsaturated non-crystalline polyester resin (A) had a number-average molecular weight (Mn) of 3,500, a glass transition point (Tg) of 61° C. and a softnening point of 106° C. The molecular weight and glass transition point (Tg) of unsaturated non-crystalline polyester resin (A) were measured as described earlier.

Synthesis Example of Unsaturated Non-Crystalline Polyester Resin Particle Dispersion Liquid A1

Into a reaction vessel equipped with an anchor wing which provide a stirring power, 180 parts by mass of methylethyl ketone and 60 parts by mass of isopropyl alcohol (IPA) were charged, the air inside the vessel was replaced with $N_2$ gas by introducing nitrogen gas, and 200 parts by mass of non-crystalline polyester resin [A] obtained by roughly pulverizing using a hammer mill was slowly added while heating the inside with an inside-oil bath device, followed by dissolving by stirring. Thus, a non-crystalline polyester resin liquid was obtained.

Subsequently, after adding 20 parts by mass of 10% aqueous ammonia to the product, 1500 parts by mass of deionized water was added using a metering pump while stirring, and the stirring was stopped when the emulsion exhibited a milky white color and the viscosity while stirring was lowered, whereby an emulsion liquid was obtained.

Subsequently, the emulsion liquid was transferred to a 3 liter separable flask equipped with stirring wings which pump up the emulsion liquid to form a wet wall on the inner wall of the reaction vessel due to a pressure difference based on centrifugal force, a refluxing device and a depressurizing device using a vacuum pump, and the emulsion liquid stirred under a condition of 58° C. of inner wall temperature of the reaction vessel and a reduced inside pressure of the reaction vessel of 8 kPa. The depressurizing was stopped when the refluxed amount reached 650 parts by mass, the inside pressure was recovered to an ambient pressure, and the liquid was cooled to an ambient temperature while stirring, whereby obtained was unsaturated non-crystalline polyester resin particle dispersion liquid [A] in which unsaturated non-crystalline polyester resin particles were dispersed. The volume median diameter of the obtained non-crystalline polyester resin particles was 164 nm.

Synthesis Example of Crosslinking Non-Crystalline Polyester Resin Particle Dispersion Liquid A2

In a mixture of 2000 parts by mass of unsaturated non-crystalline polyester resin particle dispersion liquid [A1] and 1500 parts by mass of deionized water, a polymerization initiator solution obtained by dissolving 9.8 parts by mass of potassium persulfate in 210 parts by mass of deionized water was added, and radical polymerization was carried out by heating and stirring at 80° C. for 2 hours. After the polymerization was over, the system was cooled to 28° C. to obtain crosslinking non-crystalline polyester resin particle dispersion liquid [A2] in which crosslinking non-crystalline polyester resin particles [A2] were dispersed.

Crosslinking non-crystalline polyester resin particle dispersion liquid [A2] was subjected to solid-liquid separation and the weight average molecular weight of obtained crosslinking non-crystalline polyester resin particles [A2] was determined to be 31000. The tetrahydrofuran insoluble portion, namely, a gel portion was 6.8% by mass based on the crosslinking non-crystalline polyester resin particles [A2] (solid content).

When the gel portion was analyzed by means of solid C13-NMR, although a quantitative determination was difficult, increase in the peak intensity corresponding to tertiary carbon atoms was observed when compared with that of the solid content (non-crystalline polyester resin particles) of non-crystalline polyester resin particle dispersion liquid [A1] before radical polymerization.

Synthesis Example of Crystalline Polyester Resin B

Into a reaction vessel equipped with a stirrer, a nitrogen-introducing tube, temperature sensor and rectifying column, the following was charged, Polycarboxylic acid component: 200 parts by mass of dodecane dicarboxylic acid, and Polyalcohol component: 150 parts by mass of 1,9-nonane diol.

Temperature within the system was raised to 190° C. taking one hour, after affirming that the inside of the system is stirred uniformly, catalyst Ti $(OBu)_4$ in an amount of 0.006% by mass based on the total amount of polycarboxylic acid, temperature within the system was raised to 240° C. taking 6 hours while removing generated water by distillation, and polymerization reaction was conducted by continuing dehydration condensation reaction for 6 hours while maintaining the temperature, and an crystalline polyester resin (B) was obtained.

Thus obtained crystalline polyester resin (B) had number average molecular weight (Mn) of 3100, and a melting point of 66° C. The crystalline polyester resin (B) molecular weight and the melting point of the crystalline polyester resin (B) were measured as described earlier.

Synthesis Example of Crystalline Polyester Resin Particle Dispersion Liquid B1

Crystalline polyester resin particle dispersion liquid [B1] was prepared in the same manner as described for the preparation of non-crystalline polyester resin particle dispersion liquid [A] except that 90 parts by mass of crystalline polyester resin [B] was used instead of 290 parts by mass of non-crystalline polyester resin [A]. The volume median diameter of the crystalline polyester resin particles in the obtained crystalline polyester resin particle dispersion liquid [B1] was 207 nm.

Synthesis Example of Magenta Colorant Particle Dispersion Liquid

Magenta colorant particle dispersion liquid [M] having a solid content (magenta colorant particles) of 19% by mass, in which magenta colorant particles having a volume median diameter of 181 nm were dispersed, was obtained by adding 50 parts by mass of C. I. Pigment Red 122 (produced by CLARIANT in JAPAN) into a solution of 5 parts by mass of an anionic surfactant NEOGEN®RK produced by DAI-ICHI KOGYO SEIYAKU Co., Ltd. dissolved in 195 parts by mass of deionized water, followed by dispersing with a homogenizer Ultratarax, manufactured by IKA Werke GmbH & Co. KG, for 10 minutes. The volume media diameter of the magenta colorant particles was measured using an electrophoretic light scattering photometer ELS-800 (manufactured by Otsuka Electronics Co., Ltd.).

Synthesis Example of Releasing Agent Particle Dispersion Liquid

Releasing agent particle dispersion liquid [W] having a solid content (releasing agent particles) of 20% by mass, in which the releasing agent particles having a volume median diameter of 158 nm were dispersed, was obtained by mixing 5 parts by mass of a paraffin wax FNP92 (melting point of 91° C., produced by NIPPON SEIRO Co., Ltd) into a solution of 5 parts by mass of an anionic surfactant NEOGEN®RK produced by DAI-ICHI KOGYO SEIYAKU Co., Ltd. dissolved in 195 parts by mass of deionized water, heating the mixture at 60° C., thoroughly dispersing the mixture with a homogenizer ULTRA-TURRAX® T50 (manufactured by IKA®), and further dispersing with a pressure ejection type Gaulin homogenizer. The volume media diameter of the magenta colorant particles was measured using an electrophoretic light scattering photometer ELS-800 (manufactured by Otsuka Electronics Co., Ltd.).

Production Example of Toner 1

(Oil Phase Liquid Preparation Step)

The following materials were charged in a round-bottom stainless steel flask, and thoroughly mixed/dispersed using a homogenizer ULTRA-TURRAX® T50 (manufactured by IKA®):

Non-crystalline polyester resin particle dispersion liquid [A1]: 250 mass parts;

Crystalline polyester resin particle dispersion liquid [B1]: 100 mass parts; and Magenta colorant particle dispersion liquid [M]: 100 mass parts.

Subsequently, 1.1 part by mass of poly aluminum chloride (produced by ASADA CHEMICAL Co., Ltd.) was added to the product and the mixture was heated to 47° C. using an oil bath for heating, while being subjected to a dispersion treatment using ULTRA-TURRAX® T50 (manufactured by IKA®), the temperature was further kept at 47° C. for 60 minutes, and then 350 parts by mass of crosslinking non-crystalline polyester resin particle dispersion liquid [A2] was gradually added. After the inside pH value was adjusted to 8.0 using a 0.5 mol/L sodium hydroxide aqueous solution, the stainless steel flask was sealed and heated to 90° C. and then kept for 3 hours, while stirring was continued using a magnetic seal stirring system.

After the reaction was over, the product was subjected to cooling, filtering, washing thoroughly with deionized water, and solid-liquid separation with suction filtration using a Buchner funnel. The solid content was further dispersed in deionized water at around 40° C. and stirred/washed for 15 minutes at 300 rpm. This step was repeated 5 times. When the filtrate showed a pH value of 7.02, an electrical conductivity of 9.8 μS/cm and a surface tension of 71.3 N/m, the product was subjected to solid-liquid separation with a Buchner funnel filtration system using a filter paper No. 5A (produced by Toyo Roshi Kaisha, Ltd.), and the solid content was dried at 40° C. for 12 hours under vacuum, whereby toner [1X] containing toner particles [1] was obtained.

The volume median diameter of toner particles [1] in toner [1X] was 5.3 μm, and the average circularity was 0.962.

To obtained toner [1X], 1% by mass of hydrophobic silica (number average primary particle diameter of 12 nm, hydrophobic degree of 68) was added and blended by Henschel mixer (product by Mitsui Mike Kakoki Co.). Toner [1] was produced via further external additive treatment in which coarse particles were removed employing a sieve having aperture of 45 μm.

Production Example of Toners 2 to 5

Toners [2] to [5] were obtained in the same manner as production example of toner 1 except that the adding amounts of non-crystalline polyester resin particle dispersion liquid [A1], crystalline polyester resin particle dispersion liquid [B1], magenta colorant particle dispersion liquid [M], releasing agent particle dispersion liquid [W] and crosslinking non-crystalline polyester resin particle dispersion liquid [A2] were changed as shown in Table 1. Toners [1]-[3] were inventive toners and toners [4] and [5] were comparative toners.

Production Examples of Developers 1 to 5

Developers [1]-[5] were produced by mixing 6% by mass of ferrite carrier coated with a silicone resin and having a volume median diameter of 60 μm to each of toners [1]-[5].

[Evaluation 1: Evaluation of High Temperature Storage Property]

For each of aforementioned toners [1]-[5], 0.5 g of a toner sample was placed in a glass bottle having an inner diameter of 21 mm and a capacity of 10 ml, and then closed with a cap. The bottle was shaken 600 times at room temperature using Tap Denser "KYT-2000" (produced by Seishin Enterprise Co., Ltd.). Subsequently, the toner sample in the bottle was left under the condition of 57° C. humidity of 35% RH for 2 hours with the cap open. Then, the toner was placed on a sieve of 48 mesh (open space 350 μm) with a precaution of not braking the toner aggregate, and it was set on "Powder Tester" (made by Hosokawa Micron Corporation), and it was held with a holding bar and a knob nut. The vibration strength was adjusted to the shift width of 1 mm and give vibration for 10 seconds. After the vibration, the amount of the remaining toner on the sieve was measured. The toner aggregation rate was determined according to the following scheme (1). When the toner aggregation rate was 20 mass % or less, the toner was considered to meet the standard and to have practically no problem.

$$\text{Toner aggregation rate(\% by mass)} = \{(\text{Amount of the remaining toner on the sieve (g)})/0.5\ (\text{g})\} \times 100 \qquad \text{Scheme (1)}$$

—Evaluation criteria—

A: Toner aggregation rate was less than 15% by mass (excellent)

B: Toner aggregation rate was 15% by mass or more and 20% by mass or less (good)

C: Toner aggregation rate was more than 20% by mass (not acceptable)

[Evaluation 2: Evaluation of Fixing Offset Property]

For each of toners [1]-[5], by employing commercially available digital system multi functional printer bizhub PRO C6501 (produced by Konica Minolta Business Technologies, Inc.), which was modified so that the temperature of the surface of the heat roller for fixing could be changed in the range from 100 to 210° C., a A4 size normal paper sheet (amount of toner: 80 g/m$^2$) was conveyed in the longitudinal direction, and, after a 5 mm width solid image extending in the direction perpendicular to the longitudinal direction of the paper sheet was fixed, a 5 mm width solid image and a 20 mm width half tone image, both extending in the direction perpendicular to the longitudinal direction, were fixed. This fixing procedure was repeated while the fixing temperature was changed at every 5° C. such that 100° C., 105° C. . . . .

The temperature at which stain of image due to low temperature offset and the temperature at which stain of image due to high temperature offset were measured as a temperature of low temperature offset and a temperature of high temperature offset, respectively. The results were shown in Table 1.

[Evaluation 3: Evaluation of Lowest Fixing Temperature]

For each of toners [1]-[5], by employing commercially available digital system multi functional printer bizhub PRO C6501 (produced by Konica Minolta Business Technologies, Inc.), which was modified so that the temperature of the surface of the heat roller for fixing could be changed in the range from 100 to 210° C., a fixing procedure in which a solid image having a toner adhesion amount of 11 mg/cm$^2$ was fixed on a A4 size paper sheet was repeated while the fixing temperature was changed at every 5° C. such that 100° C., 105° C.

The paper sheet obtained in the fixing procedure at each fixing temperature was folded using a folding machine so that load was applied to the solid image portion. Compressed air at a pressure of 0.35 MPa was blown to the fold portion, and the status of the fold portion was evaluated into 5 ranks as described below by referring to a criteria sample. Fixing temperature of rank 3 was made as the available lowest fixing temperature. Results were shown in Table 1.

Evaluation Criteria

Rank 5: No peeling was observed at the fold portion.

Rank 4: Peeling was observed partly along with the fold line.

Rank 3: Peeling of fine lines was observed along the fold line.

Rank 2: Peeling of bald lines was observed along the fold line.

Rank 1: Large peeling was observed.

[Evaluation 4: Glossiness]

For each of toners [1]-[5], by employing commercially available digital system multi functional printer bizhub PRO C6501 (produced by Konica Minolta Business Technologies, Inc.), which was modified so that the temperature of the surface of the heat roller for fixing could be changed in the range from 100 to 210° C., the temperature of the surface of the heat roller for fixing was set to a higher temperature between the aforementioned temperature of low temperature offset and the lowest fixing temperature. On an art coat paper sheet having a thickness of 250 g/m$^2$, a screen tint was formed by square dots of a solid image having a toner amount of 10 mg/cm$^2$ and a 50% image, and 75° glossiness of 100% image was measured using Gardner micro-gloss 75°. The results were shown in Table 1. The glossiness of 60-80 was evaluated as "A" exhibiting moderate gloss without glare, the glossiness of more than 80 was evaluated as "B" exhibiting uncomfortable feeling due to glare, and the glossiness of less than 60 was evaluated as "C" meaning unacceptable.

TABLE 1

| | | Adding amount (mass parts of solid content) | | | | | | Evaluation | | | | |
|---|---|---|---|---|---|---|---|---|---|---|---|---|
| | | Core aggregation particles | | | | Shell layer | | | | | | |
| | Toner No. | ** | Crystalline polyester resin particles | Colorant particles | Releasing agent particles | Cross-linking non-crystalline polyester resin particles | ** | High temperature storage property | Lowest fixing temperature | Temperature of low temperature offset | Temperature of high temperature offset | Glossiness |
| Example 1 | 1 | 200 | 600 | 60 | 120 | 200 | 0 | A | 125° C. | not observed | not observed | A |
| Example 2 | 2 | 600 | 200 | 60 | 120 | 200 | 0 | A | 135° C. | not observed | not observed | A |
| Example 3 | 3 | 0 | 800 | 60 | 120 | 200 | 0 | A | 120° C. | 125° C. | not observed | A |
| Comparative example 1 | 4 | 0 | 800 | 60 | 120 | 0 | 200 | B | 120° C. | 130° C. | 210° C. | B |
| Comparative example 2 | 5 | 400 | 600 | 60 | 120 | 0 | 0 | C | 110° C. | 120° C. | 200° C. | B |

**: Unsaturated non-crystalline polyester resin particles

What is claimed is:

1. A method of producing an electrostatic image developing toner comprising toner particles comprising a binder resin containing at least a non-crystalline polyester resin having a crosslinking structure and a crystalline polyester resin, the method comprising the steps of:

(a-1) preparing an aqueous dispersion liquid of particles containing a crystalline polyester resin;

(a-2) preparing an aqueous dispersion liquid of particles containing a non-crystalline polyester resin having a polymerizable unsaturated bond;

(b) preparing particles containing a non-crystalline polyester resin having a crosslinking structure by adding a radical polymerization initiator to the aqueous dispersion liquid of particles containing the non-crystalline polyester resin having a polymerizable unsaturated bond;

(c) preparing core particles by aggregating at least the particles containing the crystalline polyester resin in an aqueous medium; and (d) preparing a shell layer containing the non-crystalline polyester resin having a crosslinking structure by fusing the particles containing the non-crystalline polyester resin having a crosslinking structure on surfaces of the core particles in an aqueous medium.

2. The method of claim 1, wherein the crystalline polyester resin has a melting point of 30 to 99° C.

3. The method of claim 1, wherein the crystalline polyester resin has a melting point of 45 to 88° C.

4. The method of claim 1, wherein the crystalline polyester resin has a number average molecular weight of 100 to 10000.

5. The method of claim 1, wherein the crystalline polyester resin has a weight average molecular weight of 1,000 to 50,000.

6. The method of claim 1, wherein the non-crystalline polyester resin having a polymerizable unsaturated bond has a glass transition temperature of 20 to 90° C.

7. The method of claim wherein the non-crystalline polyester resin having a polymerizable unsaturated bond has a glass transition point temperature of 35 to 65° C.

8. The method of claim 1, wherein the non-crystalline polyester resin having a polymerizable unsaturated bond has a softening point of 70 to 220° C.

9. The method of claim 1, wherein the non-crystalline polyester resin having a polymerizable unsaturated bond has a softening point of 80 to 180° C.

10. The method of claim 1, wherein the non-crystalline polyester resin having a polymerizable unsaturated bond has a number average molecular weight of 1000 to 15000.

11. The method of claim 1, wherein the radical polymerization initiator is a water-soluble radical polymerization initiator.

12. The method of claim 1, wherein the radical polymerization initiator is potassium persulfate.

* * * * *